United States Patent [19]

Zoland et al.

[11] Patent Number: 5,011,188

[45] Date of Patent: Apr. 30, 1991

[54] FOLDER

[76] Inventors: Martin Zoland, 7 Mandeville Crescent, Toorak, Victoria, Australia, 3142; Mark Rossato, 15 Leslie Street, Richmond North, Victoria, Australia

[21] Appl. No.: 528,041

[22] Filed: May 23, 1990

[51] Int. Cl.[5] ..... B42D 3/12

[52] U.S. Cl. ..... 281/30; 281/45; 281/51

[58] Field of Search ..... 281/18, 29, 30, 45-51; 40/359

[56] References Cited

U.S. PATENT DOCUMENTS

| | | | |
|---|---|---|---|
| 371,172 | 11/1887 | Butler | 281/51 |
| 1,279,582 | 9/1918 | Petersen | 281/51 |
| 1,407,239 | 2/1922 | Weiss | 281/51 |
| 4,162,800 | 7/1979 | Gonot, Jr. et al. | 281/48 |
| 4,391,457 | 7/1983 | Gassner | 281/45 |

FOREIGN PATENT DOCUMENTS

| | | | |
|---|---|---|---|
| 319330 | 3/1919 | Fed. Rep. of Germany | 281/30 |
| 2802449 | 7/1979 | Fed. Rep. of Germany | 281/30 |

*Primary Examiner*—Mark Rosenbaum
*Assistant Examiner*—Hwei-Siu Payer
*Attorney, Agent, or Firm*—Blakely, Sokoloff, Taylor & Zafman

[57] ABSTRACT

A folder and a drawing implement, the implement including interlocking portion and the folder including holes for receiving the interlocking portion such that after receiving the interlocking portion front and back covers of the folder are locked together by the interlocking portion so as to close the folder, and the drawing implement is thereby attached to the folder.

12 Claims, 1 Drawing Sheet

FOLDER

The present invention relates to a folder and the combination of a folder and a drawing implement.

The present invention provides a folder having a first means adapted to receive second means of a drawing implement such that after reception thereof said drawing implement engages said folder and prevents said folder from being opened. After engagement of the folder and the drawing implement, the folder can only be opened thereafter by disengaging the implement and folder.

Preferably, and advantageously, said first means comprises aligned holes in the front and back covers of said folder and said second means comprises a clip of the drawing implement.

Preferably said holes are adjacent the side edges of the covers and disposed substantially midway between the top and bottom edges of the covers.

The present invention further provides the combination of the folder described above and a drawing implement having said second means and attached to said folder so as to prevent said folder from being opened.

The present invention further provides a folder and a drawing implement, said implement including interlocking means and said folder including means for receiving said interlocking means such that after receiving said interlocking means front and back covers of said folder are locked together by said interlocking means so as to close said folder, and said drawing implement is thereby attached to said folder.

Preferably, and advantageously, said interlocking means comprises a clip of the drawing implement and said receiving means comprises aligned holes in the front and back covers of the folder.

Preferably the holes are adjacent the side edges of the covers and disposed substantially midway between the top and bottom edges of the covers.

The present invention also provides a folder having front and back covers with respective aligned holes and a drawing implement attached thereto by means of a clip of the implement which on insertion into the holes latches the covers so as to close the folder.

Preferably said holes are adjacent the side edges of the covers and disposed substantiallY midway between the top and bottom edges of the covers.

The present invention also provides a method of closing a folder described above, said method comprising closing said folder so as to align said holes, and inserting said clip through said holes so as to clip said cover sheets together and thereby prevent said folder from being opened.

The present invention is particularlY advantageous as it provides a folder which can be securely closed by means of a drawing implement and at the same time provides means for attaching the drawing implement to the folder so as to keep the implement and folder together for later use. The present invention is also very simple to implement and use and does not detract from the inherent attractiveness and simplicity of a standard folder.

A preferred embodiment of the present invention will now be described, by way of example only, with reference to the accompanying drawings wherein:

FIG. 4 is a plan view of the folder when opened in a first alternate embodiment.

FIG. 5 is a plan view of the folder when opened in a second alternate embodiment.

Figure 1:
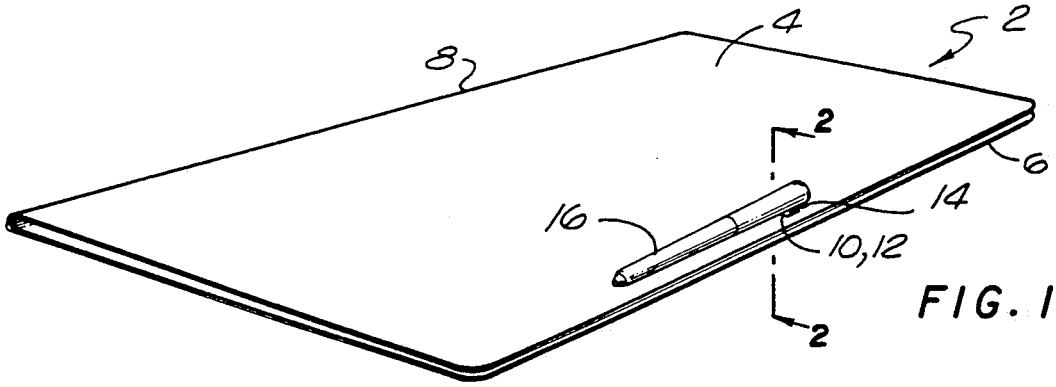
FIG. 1 is a perspective view of a preferred embodiment of a manila folder according to the present invention with a drawing implement attached thereto.

A manila folder 2, as shown in the FIGURES, includes front and back cover sheets 4 and 6, respectively, which are joined at one side thereof so as to form a spine 8 of the folder 2. Both of the covers 4 and 6 include respective holes 10 and 12 which are relatively small and are positioned so that when the folder 2 is closed, as illustrated in FIGS. 1 and 2, the holes 10 and 12 are aligned.

Figure 2:
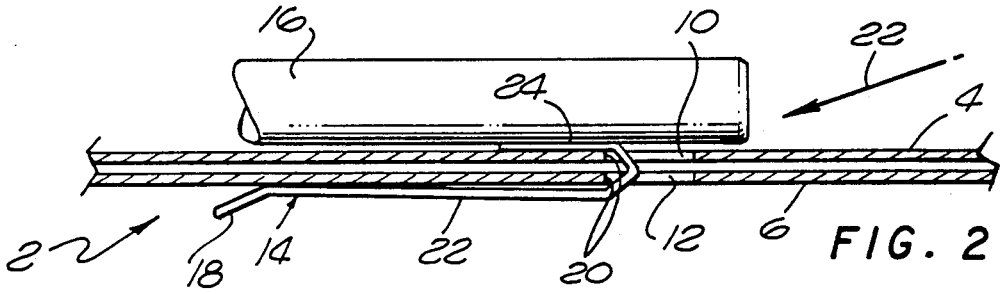
FIG. 2 is a partial side cross-sectional view of the folder of FIG. 1 illustrating attachment of the drawing implement thereto.

As the covers 4 and 6 are relativelY thin, when the folder 2 is closed and the holes 10 and 12 are aligned, the holes 10 and 12 effectively form a single hole into which the clip 14 of a drawing implement can be inserted so as to latch or clip the covers 4 and 6 together, as shown in FIG. 2. The clip 14 may be the standard clip which is included on most pens and mechanical pencils or the caps thereof. To facilitate insertion of the clip 14 into the holes 10 and 12, the clip 14 may be configured so as to include a curved protruding portion 18 at the end thereof which curves and extends away from the implement 16. The portion 18 would extend into the holes 10 and 12 and engage the bottom edges 20 of the holes 10 and 12 as the implement 16 moves towards the front cover 4 in the direction indicated by the arrow 22.

After the edges 20 have been engaged by the clip 14 and the implement 16 is moved further down towards the bottom of the folder 2, the free arm 22 of the clip 14 becomes disposed at the back of the folder 2 and engages the back cover 6 whereas the other arm or part 24 of the clip 14 attached to the implement 16 remains at the front of the folder 2. The part 24 or another part of the implement 16 abuts the front cover 4, whereas part of the free arm 22 of the clip 14 engages the back cover 6 so as to latch or lock the covers 4 and 6 together. The folder 2 can then only be opened thereafter by removing or disengaging the implement 16 therefrom.

Figure 3:
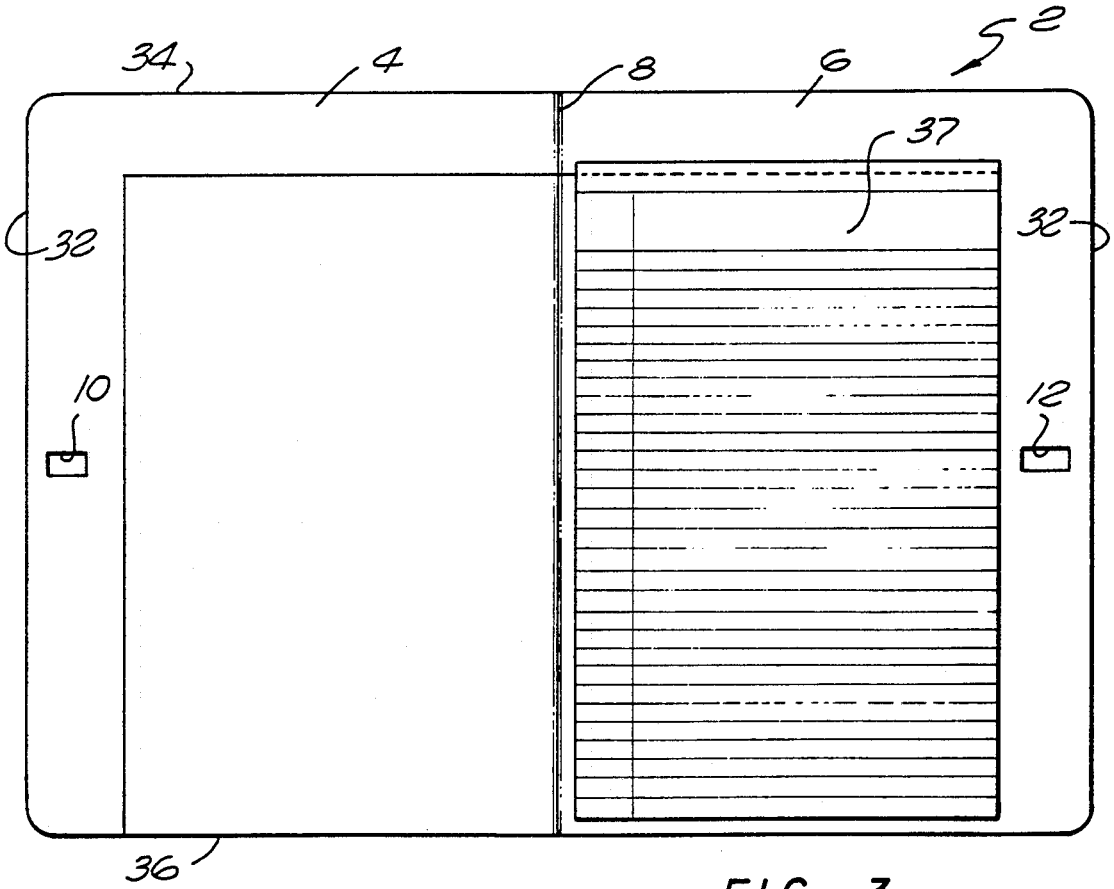
FIG. 3 is a plan view of the folder when opened.

The holes 10 and 12 of the folder 2 are placed, as shown in FIG. 3, so that when the folder 2 is closed they are not obstructed by paper or materials 30 which are held or likely to be held in the folder 2. Furthermore, the holes 10 and 12 should be placed so that when the clip 14 is inserted therein to latch the covers 4 and 6, it is difficult to remove or dislodge the materials 30 held in the folder 2. Hence, the holes 10 and 12 should be positioned so they are adjacent the side edges 32 and substantially midway between the top and bottom edges 34 and 36 of the covers 4 and 6. The folder 2 should also be made large enough so as to allow room for positioning of the holes 10 and 12 adjacent the edges 32 without the holes 10 and 12 being obstructed by materials 30 which the folder 2 is designed to hold.

Many modifications will be apparent to those skilled in the art without departing from the scope of the present invention as hereinbefore described with reference to the accompanying drawings.

We claim:

1. A folder and writing instrument combination, said writing instrument including a clip and an elongated portion, said clip having first and second ends with said first end affixed to said elongated portion, said folder including a front cover with an inside portion and an outside portion, and a back cover with an inside portion and an outside portion, said front cover and said back cover being joined at one side thereof so as to form a spine, said front and back covers having first and second edges adjacent said spine and a third edge opposite said spine, said combination comprising:

(a) a first hole disposed adjacent said third edge of said front cover opposite said spine;

(b) a second hole disposed adjacent said third edge of said back cover opposite said spine, wherein said first hole and said second hole are in alignment when said folder is in a closed position, and wherein said second end of said clip is adapted to be inserted into said aligned holes such that said clip is adjacent to outside portion of one of said front and back covers, and said elongated portion is adjacent the outside portion of the other of said front and back covers, whereby said front and back covers are secured in a closed position when said clip engages said first and second holes, and said front and back portions may be opened when said clip is disengaged from said first and second holes.

2. The combination defined by claim 1 wherein said clip includes a curved protruding portion at said second end thereof which curves and extends away from said implement portion, whereby insertion of said clip into said holes is facilited.

3. The combination defined in claim 1 wherein said holes are disposed substantially midway between said third edges of said first and second covers.

4. The combination defined by claim 3 wherein said clip includes a curved protruding portion at said second end thereof which curves and extends away from said implement portion, whereby insertion of said clip into said holes is facilited.

5. A folder and writing instrument combination, said writing instrument including a clip and an elongated portion, said clip having first and second ends with said first end affixed to said elongated portion, said folder including a front cover with an inside portion and an outside portion, and a back cover with an inside portion and an outside portion, said front cover and said back cover being joined at one side thereof so as to form a spine, said front and back covers each having first and second edges, respectively, adjacent said spine and a third edge opposite said spine, said combination comprising:

(a) a first hole disposed adjacent said first edge of said front cover adjacent said spine;

(b) a second hole disposed adjacent said first edge of said back cover adjacent said spine, wherein said first hole and said second hole are in alignment when said folder is in a closed position, and wherein said second end of said clip is adapted to be inserted into said aligned holes such that said clip is adjacent the outside portion of one of said front and back covers, and said elongated portion is adjacent the outside portion of the other of said front and back covers, whereby said front and back covers are secured in a closed position when said clip engages said first and second holes, and said front and back portions may be opened when said clip is disengaged from said first and second holes.

6. The combination defined by claim 5 wherein said clip includes a curved protruding portion at said second end thereof which curves and extends away from said implement portion, whereby insertion of said clip into said holes is facilited.

7. The combination defined by claim 5 wherein said holes are disposed substantially midway between said first edges of said first and second covers.

8. The combination defined by claim 7 wherein said clip includes a curved protruding portion at said second end thereof which curves and extends away from said implement portion, whereby insertion of said clip into said holes is facilited.

9. A folder and writing instrument combination, said writing instrument including a clip and an elongated portion, said clip having first and second ends with said first end affixed to said elongated portion, said folder including a front cover with an inside portion and an outside portion, and a back cover with an inside portion and an outside portion, said front cover and said back cover being joined at one side thereof so as to form a spine, said front and back covers each having first and second edges, respectively, adjacent said spine and a third edge opposite said spine, said combination comprising:

(a) a first hole disposed adjacent said second edge of said front cover adjacent said spine;

(b) a second hole disposed adjacent said second edge of said back cover adjacent said spine, wherein said first hole and said second hole are in alignment when said folder is in a closed position, and wherein said second end of said clip is adapted to be inserted into said aligned holes such that said clip is adjacent the outside portion of one of said front and back covers, and said elongated portion is adjacent the outside portion of the other of said front and back covers, whereby said front and back covers are secured in a closed position when said clip engages said first and second holes, and said front and back portions may be opened when said clip is disengaged from said first and second holes.

10. The combination defined by claim 9 wherein said clip includes a curved protruding portion at said second end thereof which curves and extends away from said implement portion, whereby insertion of said clip into said holes is facilited.

11. The combination defined by claim 9 wherein said holes are disposed substantially midway between said second edges of said first and second covers.

12. The combination defined by claim 11 wherein said clip includes a curved protruding portion at said second end thereof which curves and extends away from said implement portion, whereby insertion of said clip into said holes is facilited.

* * * * *

UNITED STATES PATENT AND TRADEMARK OFFICE

CERTIFICATE OF CORRECTION

PATENT NO. : 5,011,188

DATED : 04/30/91

INVENTOR(S) : Zoland et al

It is certified that error appears in the above-indentified patent and that said Letters Patent is hereby corrected as shown below:

The sheet of drawing, consisting of Fig. 4 and 5, should be added as shown on the attached page.

UNITED STATES PATENT AND TRADEMARK OFFICE

CERTIFICATE OF CORRECTION

PATENT NO. : 5,011,188

DATED : 04/30/91

INVENTOR(S) : Zoland, et al

It is certified that error appears in the above-indentified patent and that said Letters Patent is hereby corrected as shown below:

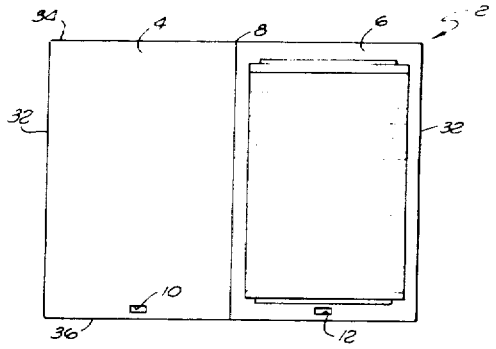

FIG. 4

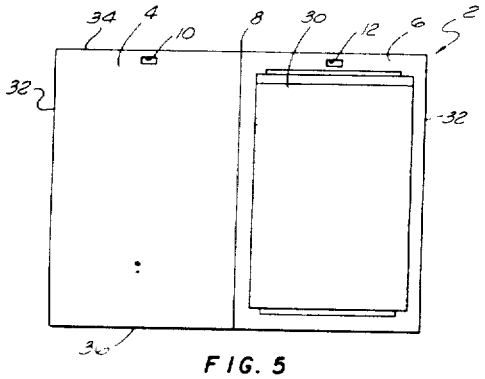

FIG. 5

UNITED STATES PATENT AND TRADEMARK OFFICE

CERTIFICATE OF CORRECTION

PATENT NO. : 5,011,188

DATED : 04/30/91

INVENTOR(S) : Zoland et al

It is certified that error appears in the above-indentified patent and that said Letters Patent is hereby corrected as shown below:

Column 3, line 28, delete "facilited" and insert --facilitated --.
line 36, delete "facilited" and insert --facilitated --.
Column 4,line 10, delete "facilited" and insert --facilitated --.
line 18, delete "facilited" and insert -- facilitated --.
line 52, delete "facilited" and insert --facilitated --.

Signed and Sealed this

Twelfth Day of April, 1994

Bruce Lehman

BRUCE LEHMAN

*Commissioner of Patents and Trademarks*

*Attest:*

*Attesting Officer*